US006734404B2

(12) United States Patent
Hays

(10) Patent No.: US 6,734,404 B2
(45) Date of Patent: May 11, 2004

(54) HEATING ELEMENTS WITH REDUCED STRAY MAGNETIC FIELD EMISSIONS

(75) Inventor: Kenneth M. Hays, Santa Ana, CA (US)

(73) Assignee: The Boeing Company, Seattle, WA (US)

( * ) Notice: Subject to any disclaimer, the term of this patent is extended or adjusted under 35 U.S.C. 154(b) by 5 days.

(21) Appl. No.: 10/103,552

(22) Filed: Mar. 21, 2002

(65) Prior Publication Data

US 2003/0178415 A1 Sep. 25, 2003

(51) Int. Cl.[7] ..... H05B 3/00

(52) U.S. Cl. ..... 219/552; 219/528; 219/549; 219/212; 219/529; 219/211; 338/62; 338/296

(58) Field of Search ..... 219/528, 558, 219/529, 549, 212, 211; 338/296, 62

(56) References Cited

U.S. PATENT DOCUMENTS

| | | | | |
|---|---|---|---|---|
| 2,891,227 A | | 6/1959 | Boykin | |
| 3,537,053 A | | 10/1970 | Snoberger et al. | |
| 3,810,254 A | | 5/1974 | Utsumi et al. | |
| 4,245,149 A | * | 1/1981 | Fairlie | 219/528 |
| 4,412,125 A | | 10/1983 | Nagasawa et al. | |
| 4,998,006 A | | 3/1991 | Perlman | |
| 5,218,185 A | | 6/1993 | Gross | |
| 5,245,687 A | | 9/1993 | Usui | |
| 5,333,214 A | | 7/1994 | Huang et al. | |
| 5,371,593 A | | 12/1994 | Cordova et al. | |
| 5,410,127 A | | 4/1995 | LaRue et al. | |
| 5,416,585 A | | 5/1995 | Hadeler | |
| 5,481,358 A | | 1/1996 | Dyott et al. | |
| 5,546,482 A | | 8/1996 | Cordova et al. | |
| 5,668,908 A | | 9/1997 | Cordova | |
| 5,814,792 A | | 9/1998 | Wildi | |
| 5,870,194 A | | 2/1999 | Cordova et al. | |

* cited by examiner

*Primary Examiner*—Shawntina Fuqua
(74) *Attorney, Agent, or Firm*—Alston & Bird LLP

(57) ABSTRACT

A wire-based heating element is provided having first and second portions twisted about each other such that magnetic flux emitted from one portion is substantially cancelled by magnetic flux emitted from the other portion. A bonding material that fixedly connects the two portions of the heating element and restricts their movement relative to each other to thereby maximize the cancellation of magnetic flux. A substrate-based heating element is also provided having traces on opposed sides of a substrate and overlying each other to cancel magnetic flux. Electrical connection pads are located on the same side of the substrate, and the second trace extends passed the first trace to connect to the second connection pad. A lead connected to the first connection pad overlies the portion of the second trace that extends to the second connection pad to thereby cancel magnetic flux emissions from this portion of the second trace.

17 Claims, 4 Drawing Sheets

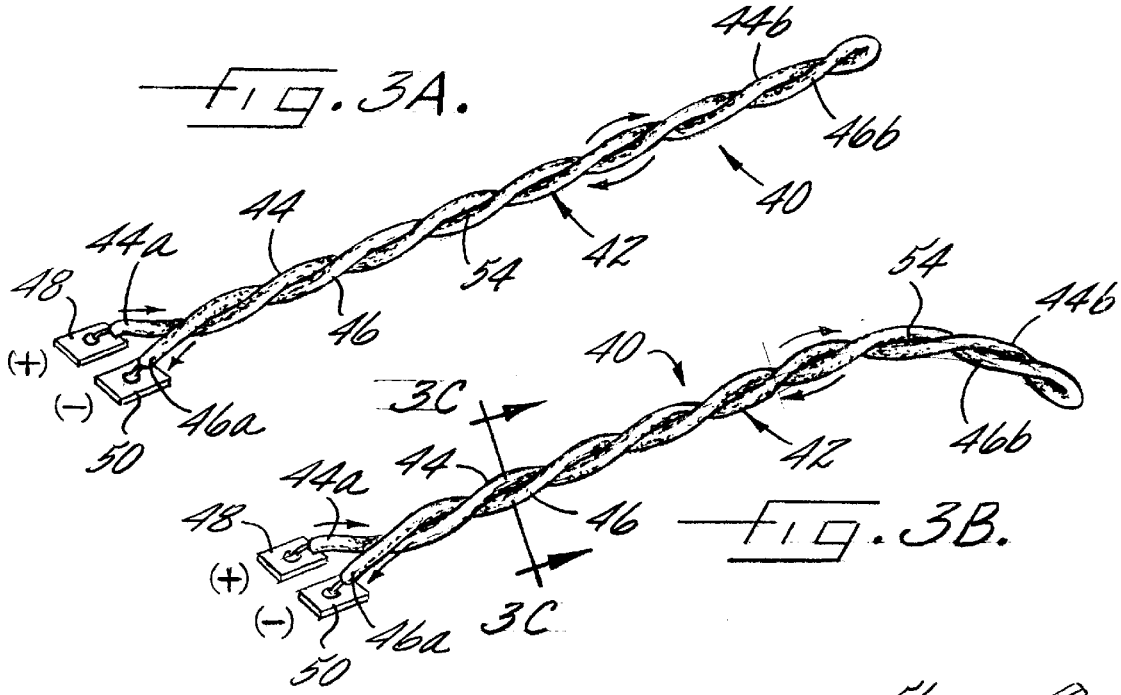
FIG. 3A.
FIG. 3B.
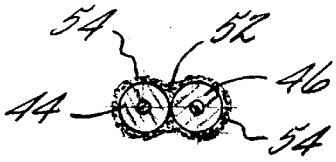
FIG. 3C.
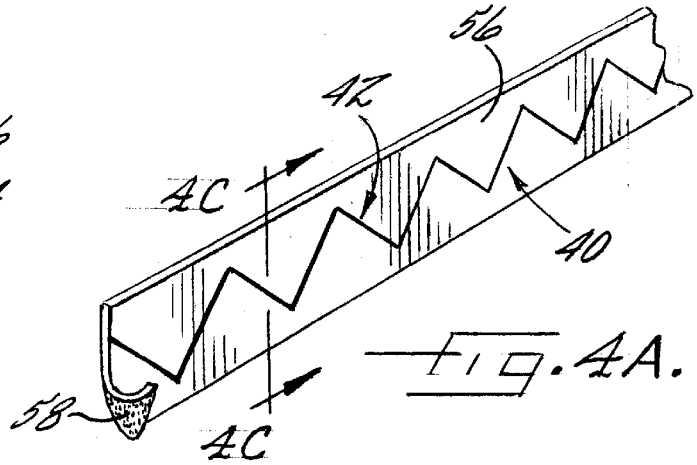
FIG. 4A.
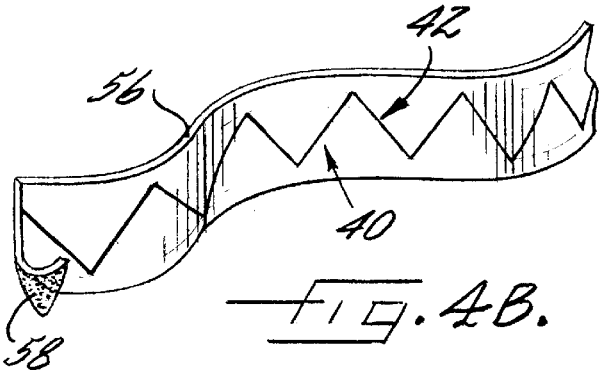
FIG. 4B.
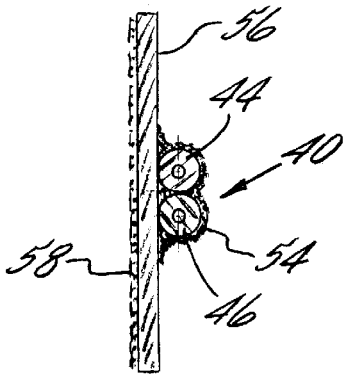
FIG. 4C.

HEATING ELEMENTS WITH REDUCED STRAY MAGNETIC FIELD EMISSIONS

FEDERALLY SPONSORED RESEARCH OR DEVELOPMENT

This invention was made with government support under contract number N00030-00-C-0006 awarded by the United States Navy. The government has certain rights in this invention.

FIELD OF THE INVENTION

The present invention relates generally to electrically resistive heating elements and more particularly to heating elements configured such that emissions of magnetic flux from the heating elements are reduced.

BACKGROUND OF THE INVENTION

Most electronic devices experience changes in operating characteristics based on their operating temperature. For most applications, these variations are slight and can either be ignored or compensated for through calibration. However, there are instances in which environmental temperature regulation is required to ensure proper operation of an electronic device. For example, in many space applications where temperatures are extremely cold, environmental temperature regulation is required. At these extreme temperatures, electronic components may have operating characteristics that are quite different from their operating characteristics at room temperature causing them to malfunction or provide erroneous readings. Further, temperature regulation is also typically required for components that are particularly sensitive to variations in temperature. One example of such a device is a precision fiber optic gyro (FOG). Precision FOGs are particularly sensitive to changes in temperature. In precision applications, changes in the operating temperature of only a few millidegrees can affect the performance of the gyros significantly.

In many applications, strip heaters are used in temperature control systems for providing heat to electronic devices. Strip heaters include a resistive element that generates heat when a current is applied thereto. The heating element is either an elongated wire or trace of resistive material deposited on a substrate. The heating element is typically arranged in a pattern over a defined area to thereby provide uniform heat over the defined area. When current is applied to the heating element, heat is emitted from the strip heater.

While strip heaters are considered an inexpensive and efficient means of providing heat to electronic devices for environmental temperature control, there are some drawbacks to these devices. Specifically, as known in the art, when a current is applied to an elongated wire or trace, a magnetic field or flux is emitted from the heating element. This magnetic flux is problematic for several reasons. In terms of public safety, studies have linked high magnetic flux emissions as contributing to increased risk of cancer and other health problems. In addition, in terms of electronic device design, magnetic flux emissions, even at substantially lower levels, are known to negatively effect the performance of electronics and some types of fiber optics. Stray magnetic flux can also introduce output changes, drift, or noise into electronic components, which can corrupt data signals in an electronic device.

The magnetic flux emitted from a wire having infinite length is defined by the equation:

$$B=(\mu_0 i)/(2\pi d)$$

where:

$\lambda_0=4\pi\times10^{-7}$ henries per meter;

i=amperes (AC and/or DC); and d=distance from wire in meters.

As mentioned above, many conventional strip heaters employ elongated heating elements that are formed into patterns. These elongated heating elements can produce significant levels of magnetic flux. As seen from the equation above, the amount of flux emitted is inversely proportional to the distance d from the heating element. In most cases, the heating element is placed as close as possible to the item to be heated, thereby intensifying the amount of magnetic flux to which the element to be heated is subjected. Thus, although a strip heater element will serve to raise or regulate the operating temperature of the electronic device to a desired level, the magnetic flux emitted by the strip heater can adversely affect the electronic device's operation.

Considerable effort, costs, and research is expended in electronic device design applications to shield devices from and eliminate sources of magnetic flux that may disrupt operation of the electronic device. For example, FIGS. 1A and 1B illustrate one conventional strip heater 10 having somewhat reduced magnetic flux emissions. As illustrated, the heater 10 includes a continuous heating element 12 that is folded in half to form two portions, 14 and 16. To reduce magnetic flux emissions, the two portions 14 and 16 are twisted about each other. When current is applied, as shown by the current arrows, current flows through the first portion 14 of the heating element 12 in one direction and through the second portion 16 in an opposite direction. In this configuration, because the current is the same magnitude through both portions, 14 and 16, magnetic flux emitted from the first portion 14 of the heating element is substantially cancelled by the magnetic flux emitted from the second portion 16.

Importantly, the amount of magnetic flux emission cancellation is related to the proximity of the first 14 and second 16 portions of the heating element to each other. In other words, the tighter the heating elements are twisted about each other, and the finer the elements are in terms of average diameter, the better the magnetic flux cancellation. Separations and air gaps between the first and second portions of the heating element, however, and the use of loosely wound, poorly-anchored, large diameter (0.010 inches or more) wires reduce the level of magnetic flux cancellation. As such, it is important to eliminate separations and air gaps between the first and second portions of the heating element for maximum magnetic flux cancellation.

Current heating element designs, however, do not properly address these problems. Specifically, for the most part, twisted heating element type strip heaters have been employed in heating blankets and similar applications. In these applications, heating elements are typically placed in the blanket material in a loose fashion. In this instance, the heating element is free to flex with the movements of the blanket. The flexing of a heating blanket also flexes the heating element allowing for separations and/or air gaps to form between the first 14 and second 16 portions of the heating element 12. For example, FIG. 1B illustrates a conventional heating element 12 in a flexed state. As can be seen, because the first and second portions are not fixed with respect to each other, air gaps 18 form in the flexed heating element, which thereby increase the amount of net magnetic flux emissions, (i.e., non-cancelled), by the heating element. While generally safe for human use, such heating blankets and similar devices can typically emit flux at levels tens or hundreds of times higher than many sensitive electronic devices can tolerate.

Some strip heating elements are substrate based, which means they are formed by depositing resistive traces on a substrate as opposed to wires. Advances have also been made to these substrate-based strip heaters to reduce magnetic flux emissions. In these systems, it is difficult to manufacture the heating element so that it has two portions twisted about each other. For this reason, conventional low flux substrate-based strip heater systems can be designed such that the resistance traces overlay each other on the opposed sides of the substrate. FIG. 2 illustrate a typical substrate-based strip heater system. Specifically, the strip heater system 20 includes a substrate 22 and first and second electrically resistive traces, 24 and 26. Importantly, the first and second traces are located on opposed sides of the substrate 22. The two traces each have opposed ends, (24*a* and 24*b*) and (26*a* and 26*b*), and bodies 24 and 26. Importantly, the bodies of each of the traces overlay each other in a corresponding pattern. Further, the opposed ends 24*b* and 26*b* are connected to each other by a via 28 extending through the substrate 22 to create a continuous heating element between the first ends 24*a* and 26*a*. In these systems, similar to the heating elements illustrated in FIG. 1A, current is applied to one end 24*a* of the trace and current (A.C. or D.C.) flows in opposite directions between the traces at any instant as shown by the arrows. This opposite flow causes a cancellation between the magnetic flux emitted by one trace and the magnetic flux emitted by the other trace.

Although these conventional substrate-based strip heating systems effectively reduce the amount of harmful magnetic flux emitted, present substrate-based strip heater designs do not maximize magnetic flux reduction. Specifically, as illustrated in FIG. 2, in many current substrate-based strip heater designs, the patterns of the first and second traces, 24 and 26, do not match each other at the location where they are connected to the via 28. Instead, there is a loop 30. This non-matching pattern area 30 results in a net magnetic flux emission between the portions, 32*a* and 32*b*, of the first and second traces, 24 and 26, because they do not sufficiently overly each other so as to maximize magnetic flux cancellation.

Additionally, for most substrate-based strip heater applications, it is advantageous to form connection pads, 34 and 36, on the same side of the substrate 22. To accomplish this, the contact pads 34 and 36, are offset from each other on the same surface, and the trace on the opposed surface, in this case the second trace 26, is redirected to the position of its corresponding connection pad 36. The trace 26 is connected to the connection pad 36 by a via 38 extending through the substrate. As illustrated, the pattern of the second trace 26 again diverges from the pattern of the first trace 24. Here again, because the patterns do not overly each other for the portion 32*b*, magnetic flux emissions are not effectively minimized.

SUMMARY OF THE INVENTION

In light of the problems with the conventional heating elements discussed above, the present invention provides both wire-based and substrate-based heating elements that effectively minimize the amount of magnetic flux emitted. Specifically, the heating elements of the present invention reduce the number of potential gaps, loops, and separations between the portions of a heating element that can cause a net magnetic flux emission.

For example, in one embodiment, the present invention provides a wire-based heating element having a body comprising first and second portions that are twisted about each other such that magnetic flux emitted from current flowing in one portion of the heating element is substantially cancelled by magnetic flux emitted from current flowing in the other portion of the heating element. Importantly, in this embodiment, the heating element further includes a bonding material that at least partially overlays the first and second portions of the heating element. The bonding material fixedly connects the two portions of the heating element that are twisted about each other together and restricts their movement relative to each other. This, in turn, reduces the potential for separations and/or air gaps between the first and second portions that would create a net magnetic flux emission by the heating element.

In addition to providing bonding material to fixedly connect the two portions of the heating element relative to each other, the present invention, in some embodiments, also provides a backing material for supporting the first and second portions of the heating element. More specifically, one embodiment of the present invention provides a backing material to which the first and second portions of the heating element are fixedly connected by the bonding material. In this embodiment, the backing material further reduces the amount of flex between the first and second portions of the heating element thereby minimizing the numbers of separations and/or air gaps that can be introduced between the first and second portions when the heating element is flexed. In a further embodiment, the backing material may further include an adhesive layer on a side opposite from the location of the heating element. The adhesive layer allows the heating element to be fixedly connected to a body to be heated by the heating element. Alternatively, the adhesive layer can be on the same side of the backing material as the heating element.

The present invention also provides embodiments in which the heating element itself is attached to the backing material in a serpentine pattern. The serpentine pattern effectively decreases the strain in the heating element due to tension forces that may be applied to the heating element during flexing. The pattern also provides for more uniform heating. In this embodiment, because the first and second portions of the heating element are fixedly bonded together and are further bonded to the backing material by the bonding material and because of the serpentine pattern of the heating element on the backing material, the present invention effectively minimizes the number of separations and/or air gaps that can be introduced between the first and second portions of the heating element that would create a net magnetic flux emission.

In some embodiments, the heating element of the present invention has a specific length corresponding to a desired heat output for the element. In these embodiments, the heating element may be required to fit within a selected area of the backing material to provide heat within that given area. In this embodiment of the present invention, the heating element, having a selected length L defines a serpentine pattern within the selected area having a width w and a length d. In this instance, the serpentine pattern creates zigzag portions that form triangles having a base 2× and sides r. To properly fit the selected length L of the heating element in the selected area, the zigzag portions of the heating element have a selected triangle base width. Specifically, if the area of the backing in which the heating element is to be patterned has a width w and a length d and a heating element has an overall length of L, then half of the base length (x) of each triangle in the zigzag pattern will be defined by the following equation:

$$x=w[(L^2/d^2)-1]^{-1/2}.$$

In addition to providing wire based heating elements, the present invention also provides substrate-based heating elements. The substrate-based heating elements of the present invention reduce the number of loops and gaps between the first and second portions of the heating element, thereby minimizing the amount of magnetic flux emissions. For example, in one embodiment, the present invention provides a substrate-based strip heater having first and second heating element traces respectively located on first and second opposed sides of a substrate. The first and second traces have at least one of a corresponding pattern and a corresponding position relative to each other, such that magnetic flux emitted from current flowing in the first trace is substantially cancelled by magnetic flux emitted from current flowing in the second trace. The heating element of this embodiment further includes a first connection pad located on the first side of the substrate in electrical communication with the first trace. Additionally, the heating element further includes a second connection pad also located on the first side of the substrate in electrical communication with the second trace. There are first and second leads respectively connected to the first and second connection pads for applying electrical current thereto.

Importantly, in this embodiment, for the first and second connection pads to be located on the same side of the substrate, the second connection pad is offset from the location of the first connection pad by a selected offset distance. In this instance, a portion of the second trace is offset from the position of the first trace in order to connect to the second connection pad. To reduce the magnetic flux emissions from the offset portion of the second trace, the first lead extends along the first surface of the substrate overlying the portion of the second trace that is offset from the first trace. As such, the magnetic flux emitted from the offset portion of the second trace is effectively cancelled by the magnetic flux emitted from the portion of the first lead that overlies the second trace.

For example, in one embodiment, the second connection pad is located at position in front the first connection pad, and the second trace extends past the position of the first connection pad to connect the second connection pad. In this embodiment, the second trace substantially overlies the entire length of the first trace so that the magnetic flux from the first trace is substantially cancelled by the magnetic flux emitted by the second trace. Further, the first lead of this embodiment extends from the first connection pad over the portion of the second trace that extends past the first connection pad to the second connection pad to thereby substantially cancel the flux emitted from this section of the second trace.

BRIEF DESCRIPTION OF THE DRAWINGS

Figure 1A:
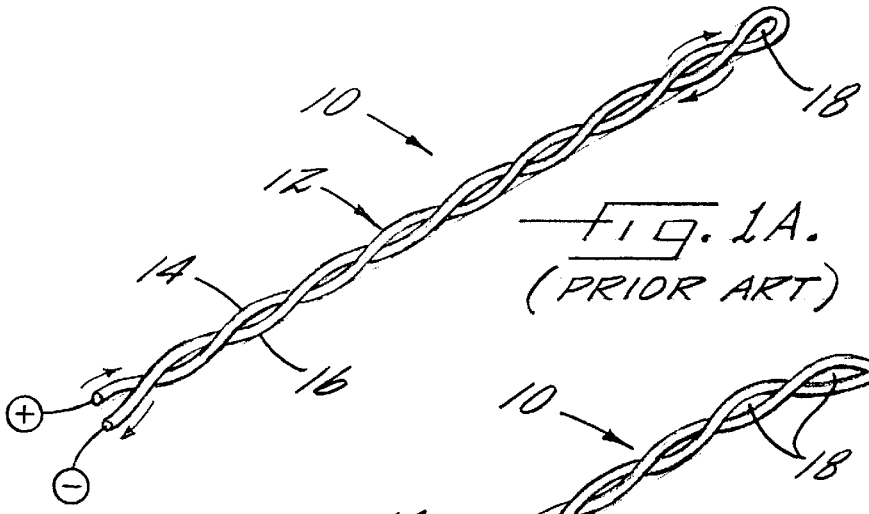
Fig. 1A. (PRIOR ART)

Having thus described the invention in general terms, reference will now be made to the accompanying drawings, which are not necessarily drawn to scale, and wherein:

FIG. 1A is an illustration of typical prior art wire-based heating element.

Figure 1B:
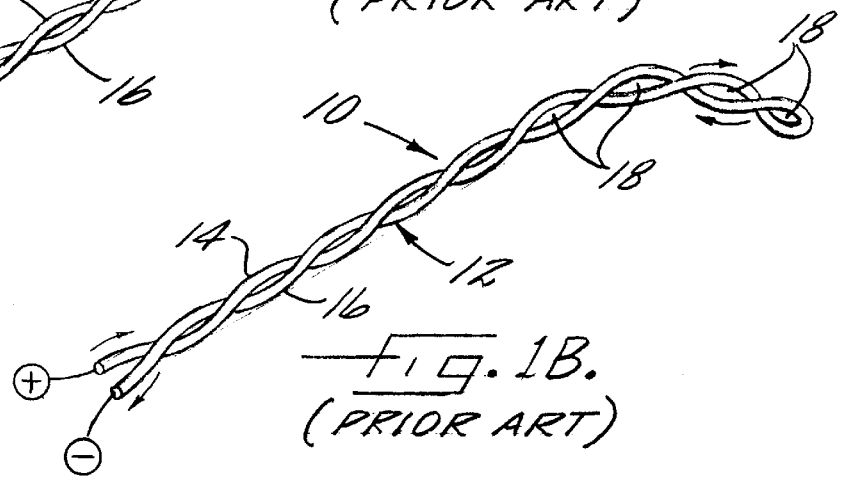
Fig. 1B. (PRIOR ART)

FIG. 1B is an illustration of typical prior art wire-based heating element in a flexed orientation.

Figure 2:
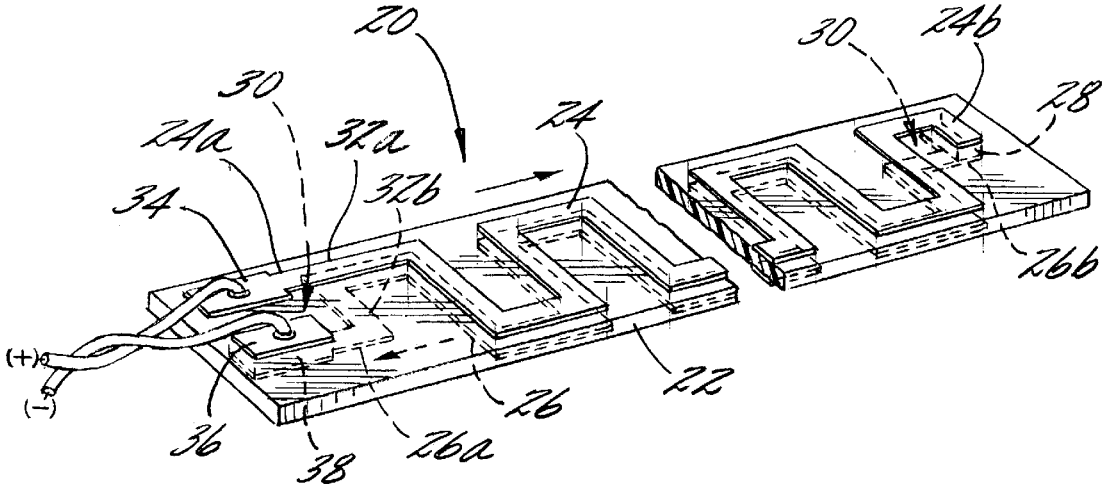
Fig. 2. (PRIOR ART)

FIG. 2 is an illustration of typical prior art substrate-based heating element.

FIG. 3A is an illustration of a wire-based heating element according to one embodiment of the present invention.

FIG. 3B is an illustration of a wire-based heating element according to one embodiment of the present invention in a flexed orientation.

FIG. 3C is an enlarged cross-section view along cut line 3C—3C in FIG. 3B.

FIG. 4A is an illustration of a wire-based heating element attached to a backing material according to one embodiment of the present invention.

FIG. 4B is an illustration of a wire-based heating element attached to a backing material according to one embodiment of the present invention in a flexed orientation.

FIG. 4C is an enlarged cross-section view along cut line 4C—4C in FIG. 4B.

Figure 5:
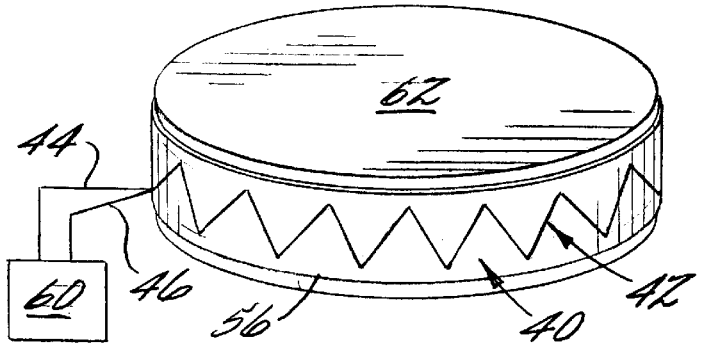

FIG. 5 is an illustration of a wire-base heating element according to one embodiment of the present invention attached to a fiber optic gyro.

Figure 6A:
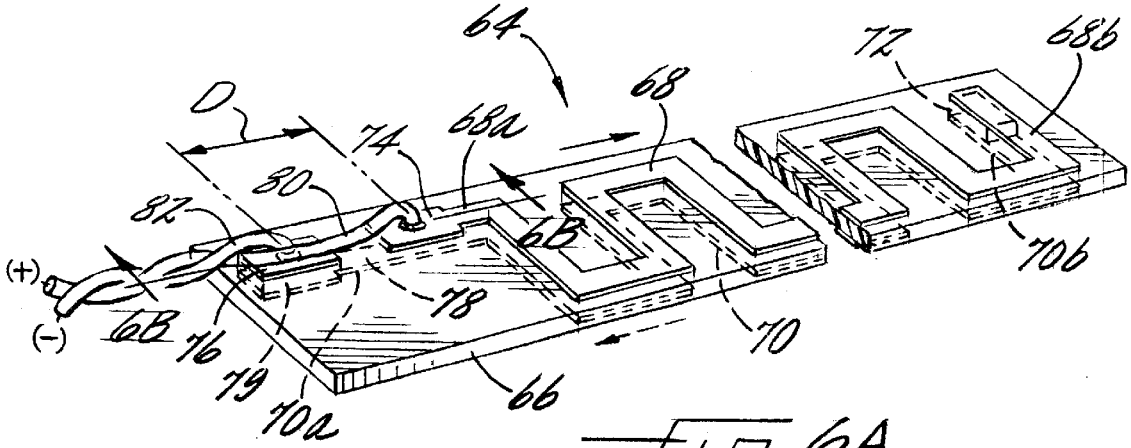

FIG. 6A is an illustration of substrate-based heating element according to one embodiment of the present invention.

Figure 6B:
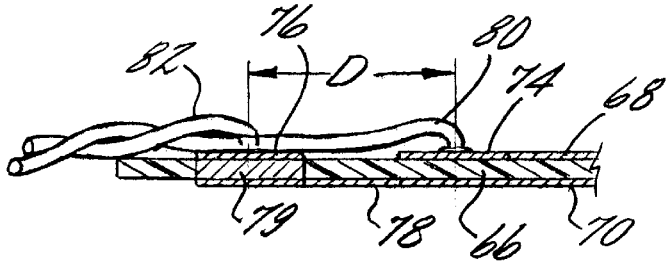

FIG. 6B is an enlarged cross-section view along cut line 6B—6B in FIG. 6A.

Figure 7A:
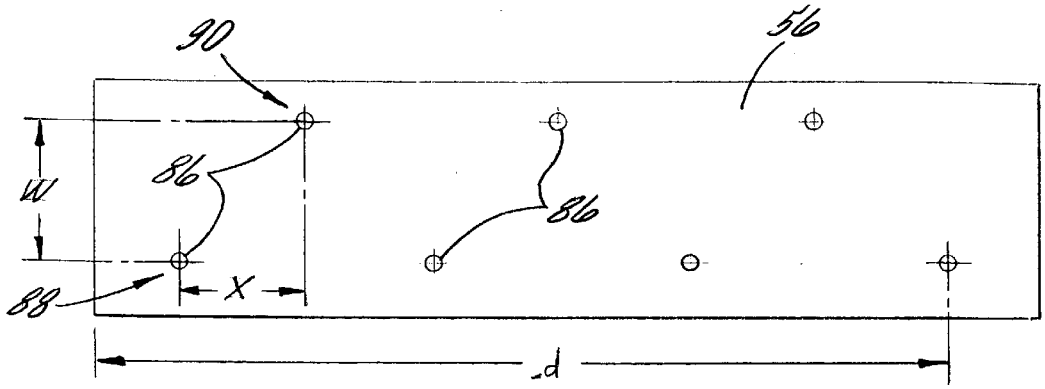
Figure 7B:
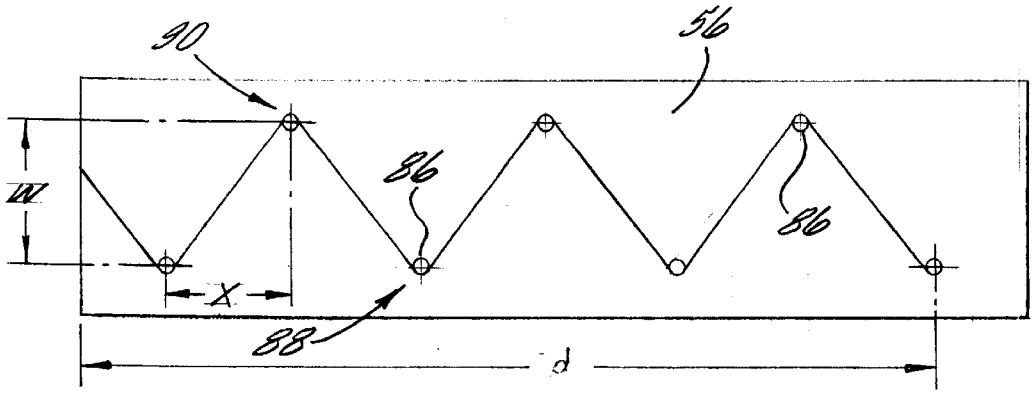
Figure 7C:
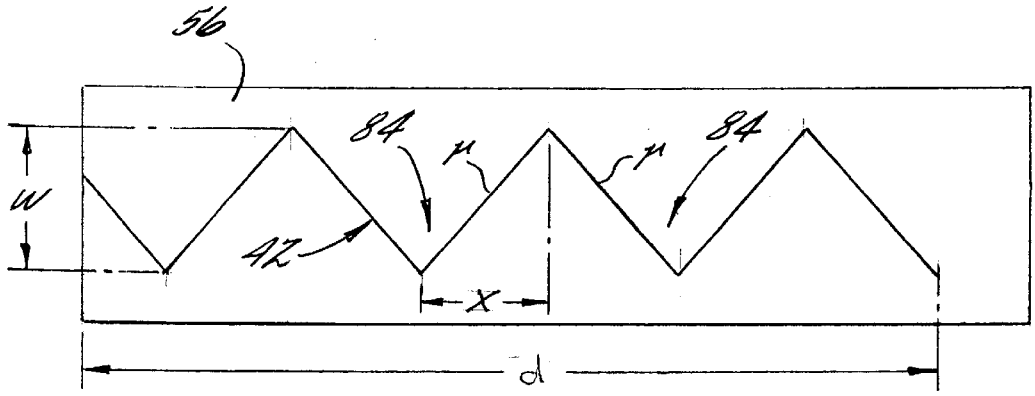

FIGS. 7A–7C illustrate fabrication of a wire-based heating element according to one embodiment of the present invention.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

As discussed in detail, the present invention provides heating elements having reduced magnetic flux emissions. Specifically, in one embodiment, the present invention provides a heating element having a body made of two portions that are twisted about each other. Current is applied to the heating element to produce heat to the environment about the heating element. The current flows through the first portion to the second portion of the heating element. In this configuration, magnetic flux emitted from current flowing in one portion is substantially cancelled by magnetic flux emitted from current flowing in the other portion such that little to no measurable magnetic flux is emitted from the heating element. Importantly, the present invention uses a bonding material that at least partially covers the two portions of the heating element. The bonding material restricts movement of the two portions of the heating element relative to each other. This, in turn, substantially eliminates separations and/or air gaps from forming between the first and second portions of the heating element that might otherwise decrease the magnetic flux cancellation between the first and second portions. As such, the bonding material allows the heating element to be flexed or otherwise moved, without a significant increase in the net magnetic flux emitted from the heating element.

With reference to FIG. 3A, an example of this embodiment of the heating element of the present invention is illustrated. Specifically, the present invention provides a heating element 40 having a body 42 formed of two portions, 44 and 46. Each portion respectively has first and second ends, (44*a*–44*b*) and (46*a*–46*b*). The first ends, 44*a* and 46*a*, of the portions are respectively connected to connection pads, 48 and 50. The opposed ends, 44*b* and 46*b*, are connected together so as to form a continuous current path between the connection pads, 48 and 50. The first and second portions of the heating element are twisted about each other tightly so as to minimize any locations where the two portions do not touch. Particular attention is paid to the transition area 52 between the first and second portions, 44 and 46, of the heating element 40 to ensure that the loop 52 is minimal with minimal to no air gap.

Importantly, the heating element of the present invention further includes a bonding material 54 that at least partially overlies the first and second portions of the heating element. This is better illustrated in FIG. 3C. The bonding material fixedly connects together the portions, 44 and 46, of the heating element that are twisted about each other. As shown in FIG. 3B, where the heating element is flexed. The bonding material restricts the movement of the first and second portions relative to each other. In other words, the bonding material fixedly connects the two portions together so that they will not separate from each other. This, in turn, minimizes variations in flux cancellation between the portions if the heating element is flexed. As such, the heating element of the present invention can be moved, flexed, etc. without diminishing the flux cancellation characteristics of the heating element.

In most embodiments, the bonding material is a varnish that is applied with a brush or sprayer over the heating element, but can be any bonding agent. Preferable bonding agents have some degree of flexibility and elasticity so that they will flex with the heating element.

With reference to FIGS. 4A–4C, in some embodiments, it is advantageous to provide a backing material 56 for the heating element 40. This backing material provides further support to the heating element and may also be used to connect or attach the heating element to a surface of a device to be heated. In the latter case, a layer of adhesive material 58 is deposited on the backing material 56 for adhering the heating element to a surface. In some embodiments, the backing material is a form of tape, such as masking tape, electrical tape, metallic foil tape, etc. Importantly, in this embodiment as shown in FIG. 4C, the bonding material 54 overlies the heating element 40 and bonds the heating element 40 to the backing material 56, such that the heating element is fixedly connected to the backing material. As illustrated in FIG. 4B, when the heating element and backing material are flexed, the bonding material maintains the first and second portions, 44 and 46, in a fixed configuration relative to each. The bonding material keeps separations and/or air gaps from forming between the first and second portions that could reduce the degree of magnetic flux cancellation between the two portions of the heating element.

As mentioned previously, precision fiber optic gyros (FOGs) are sensitive to even slight variations in operating temperature and as such, require temperature control devices to maintain the FOGs at a desired temperature. With reference to FIG. 5, in view of this problem, the present invention provides a heating element similar to the one illustrated in FIGS. 4A and 4B for use in temperature regulation of FOGs. The heater includes a heating element 40 having a body 42 with first and second portions, 44 and 46, twisted about each other. The ends of the heating element are connected to a power source 60. In use, current flows through the first portion to the second portion back to the power source. The magnetic flux emitted by the first portion is substantially cancelled by that emitted by the second portion. Bonding material 54 holds the first and second portions of the heating element in fixed relationship to each other and also bonds them to a backing material 56. The backing material includes an adhesive layer 58. The adhesive layer is used to attach the strip heater to the either the surface of the FOG 62 or to a surface near the FOG so as to provide heat to the environment surrounding the FOG. As illustrated, the surface of the FOG has a curved shape, and the heating element is flexed so as to adhere to the surface of the FOG. Importantly, the bonding material maintains the first and second portions of the heating element in a fixed relationship to each other such that separations and/or air gaps do not form between the portions when the heating element is flexed into the curved shape.

As illustrated in the above embodiments, the heating element is formed from wire. It must be understood that any type of wire may be used that will provide desired heating characteristics. The wire should, however, be coated with insulation so that the wire does not short circuit when twisted about itself. As an example of suitable wire, in one embodiment, the present invention uses enamel insulated, manganin wire having a diameter of 0.005 inches. Any gauge wire can be used, but wires having a diameter in the range of 0.010 to 0.001 inches have demonstrated acceptable performance.

As mentioned previously, heaters designed according to the present invention have little to no measurable net flux emissions. For example, a seven (7) watt heater was designed according to the present invention. The heater had flux emissions between zero, (immeasurably small, using a flux-gate magnetometer sensitive to at least 0.005 gauss), and at worst about 0.05 gauss, measured while touching the heater, (i.e., distance>0.005 inches, allowing for paint and other coatings on the meter probe).

In addition to providing wire-based strip heaters, the present invention also provides substrate-based heaters that minimize the net magnetic flux emitted by the strip heater. Specifically, FIGS. 6A and 6B illustrates a substrate-based heater according to one embodiment of the present invention. The heater 64 of this embodiment, includes a substrate 66 having first and second opposed sides. First and second electrically resistive traces, 68 and 70, are respectively deposited on the opposed sides of the substrate. Importantly, the traces, 68 and 70, are patterned and positioned relative to each other such that they overly one another. In this configuration, if a current flows in one direction in the first trace and in an opposite direction in the second trace, the magnetic flux emitted from the first trace will be substantially cancelled by the magnetic flux emitted from the second trace.

Each trace includes respective first, 68*a* and 70*a*, and second, 68*b* and 70*b*, ends. The second ends are connected to each other by a via 72 extending through the substrate to create a continuous circuit path between the first ends, 68*a* and 70*a*, of the traces. With regard to the connection of the second ends of the traces, the substrate-based heating element of the present invention differs from the conventional substrate-based heating element 20 illustrated in FIG. 2 in one significant aspect. Specifically, as shown in FIG. 6A, the traces, 68 and 70, of the present invention overly each other up until the point that they connect to the via 72. The traces do not include a loop 30 as does the conventional substrate-based heating element 20 illustrated in FIG. 2. Because the traces overly each other as opposed to forming a loop, the magnetic flux emitted by the first and second traces are more efficiently cancelled such that less net magnetic flux is emitted by the heating element of the present invention.

Although not required, in some embodiments of the present invention, it is desired to make connections to both the first and second traces from one side of the substrate. This allows the opposite side of the substrate to remain flush with the surface of the device to be heated by the heating element. For example, as illustrated in FIGS. 6A and 6B, the substrate-based strip heater 64 of this embodiment of the present invention includes first and second connection or contact pads, 74 and 76, respectively, for connection to the first and second traces, 68 and 70. In this embodiment, the connection pads are both located on the first surface of the substrate 66. They are offset from each other by a distance D. Importantly, in this embodiment, a portion 78 of the second trace 70 is offset from the position of the first trace 68 in order to connect to the second connection pad 76 by a via 79 extending through the substrate 66. As discussed previously, the portion 78 of the second trace 70 not overlying the first trace 68 is problematic as it emits magnetic flux that should be eliminated to prevent the magnetic flux from interfering with the electronic device with which the heating element is associated.

The substrate-based strip heating element of the present invention eliminates this problem in two ways. First, instead of placing the second connection pad at a position beside the first connection pad, the second connection pad of the present invention is placed at an offset D passed the first connection pad 74, such that the second trace 70 extends passed the end 68*a* of the first trace 68 and the first connection pad 74. In this configuration, unlike the conventional heating element of FIG. 2, the second trace 70 substantially underlies the entire length of the first trace 68, such that all of the magnetic flux emitted by the first trace 68 is cancelled by the magnetic flux emitted by the portion of second trace 70 that underlies the first trace 68. In other words, unlike the conventional substrate-based strip heater 20 of FIG. 2, all portions of the first trace 68 of the heater 64 of the present invention is overlaid by the second trace 70.

As illustrated in FIGS. 6A and 6B, the substrate-based strip heater 64 of the present invention further includes first and second leads, 80 and 82, respectively connected to the first and second connection pads, 74 and 76. Importantly, as illustrated, the first lead 80 extends along the first surface of the substrate overlying the portion 78 the second trace 70 that is offset past the first trace 68 and first connection pad 74. In this configuration, the magnetic flux emitted by the portion 78 of the second trace is substantially cancelled by the magnetic flux emitted from the portion of the first lead that overlies the portion 78 of the second trace. As such, the substrate-based strip heater 64 of this embodiment of the present invention allows for both the first and second connection pads, 74 and 76, to be located on the same surface, while at the same time substantially canceling the magnetic flux emitted by the first and second traces, 68 and 70, along their entire length.

As mentioned above with regard to both the wire-based and substrate-based strip heaters, the wire or traces are typically formed in a pattern on the backing or substrate so as to provide uniform heat within a given area. In addition to providing designs for heating elements that more effectively reduce net magnetic flux emissions, the present invention also provides methods for placement of the heating elements on a backing or substrate having a defined area such that the heating element provides a desired wattage of heat within the defined area. Specifically, FIG. 7C illustrates an embodiment of the present invention in which the body of the heating element is formed in a serpentine or zigzag pattern on a backing material 56 having an area defined by width w and length d. In this embodiment, the serpentine or zigzag pattern is formed of individual triangles 84 having sides length r and base length 2× where each triangle is dimensioned such that a needed length L of the heating element body 42 fits within the area of the backing material 56, (i.e., w×d). Specifically, in this embodiment, the half the length x of the base of each triangle formed by a zigzag portion of the body of the heating element is:

$$L/d=r/x, \text{ given } x^2+w^2=r^2$$

$$r=xL/d,\ x^2=r^2-w^2$$

$$x=w[(L^2/d^2)-1]^{-1/2}.$$

Using this dimension, the heating element can be defined within the area of the backing to provide the desired heating.

The following is an example of the use of the above equation to construct a heater according to the present invention. For example, if an application requires five (5) watts of heat and uses a 24 Volt power source, then the needed total resistance is $R=V^2/W=115.2\ \Omega$. If a heating element is chosen that has a resistance value per foot of 24.0 Ω/ft, then it will require 4.8 ft or 57.6 inches of the heating element. Since the heating element is folded in two, then the length L of the heating element is 28.8 inches. If the backing material has a width w=⅝ inches and a length of d=15 inches, then half the base x is equal to:

$$x=0.625(28.8^2/15^2-1)^{-1/2}$$

$$x=0.625(2.6864)^{-1/2}$$

$$x=0.625(0.610)$$

$$x=0.381 \text{ inches.}$$

With reference to FIGS. 7A–7C, to manufacture the heater of this example, the backing material 56 is first spread across a flat surface. The heating element 42 is selected, cut to length, folded in half, and twisted about itself into a tight wind, ensuring that there are little to no separations or air gaps between the two portions of the heating element. Pins 86 or other type guides are then used to lay out the zigzag pattern on the backing material. Specifically, a first row of pins is placed in a row spaced apart by 2× along one peripheral width edge 88. Another row of pins are placed at the opposite peripheral width edge 90 offset by x from the first row and spaced apart from each other by a distance 2×. The heating element is then routed around each pin in a serpentine fashion. Finally, a bonding material is applied to the heating element and the backing material to bond the two portions of the heating element to each other and also to the backing material. After the bonding material has cured, the pins are removed to provide the heating element. Although not illustrated, it is understood that the heater of this example could also be implemented in a substrate-based heating system using known etching and/or deposition techniques.

The example above illustrates the application of one continuous heating element to meet a desired heat for a given area. It must be understood however that more than one heating element can be used. For example, several heating elements could be placed on the backing material either in parallel or in series to provide the desired heat output.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A heater having reduced stray magnetic field emissions comprising:

at least one electrically conductive heating element having a body comprising first and second portions that are twisted about each other such that magnetic flux emitted from current flowing in one portion is substantially cancelled by magnetic flux emitted from current flowing in the other portion; and a bonding material at least partially overlying said first and second portions of said heating element, wherein said bonding material fixedly connects together said portions of said heating element that are twisted about each other such that said portions are restricted from movement relative to each other thereby minimizing variations in flux cancellation between said portions if the heating element is flexed.

2. A heater according to claim 1 further comprising a backing material for attaching said heating element thereto.

3. A heater according to claim 2, wherein said bonding material bonds said heating element to said backing material.

4. A heater according to claim 1 further comprising an adhesive layer attached to said backing material for adhering said backing material and heating element to a surface.

5. A heater according to claim 2, wherein at least a portion of said body of said heating element is attached in a serpentine pattern to said backing material to decrease strain on said heating element due to a tension force applied to said heating element.

6. A heater according to claim 2, wherein said backing material has a defined length and width, wherein said heating element has a length selected to provide a desired amount of heat, and wherein at least a portion of said body of said heating element is attached in a serpentine pattern to said backing material so as to decrease the length of said heating element such that said heating element will fit within the defined length and width of said backing material.

7. A heater according to claim 2, wherein said body of said heating element forms a zigzag pattern on said backing material, and wherein for each zigzag portion, said body of said heating element forms a triangle having sides r and a base 2×.

8. A heater according to claim 7, wherein said first and second portions of said heating element each have a length L and said backing material has an area with a length d and a width w defined thereon, and wherein half the length of said base of the triangle formed by a zigzag portion of said body of said heating element is:

$$x=w[(L^2/d^2)-1]^{-1/2}.$$

9. A heater according to claim 1, wherein said heating element is composed of two electrical heating elements having bodies extending between opposed ends, wherein an end of said first heating element is connected to a corresponding end of said second heating element in order to create a continues circuit path between opposed ends of said heating elements.

10. A heater having reduced stray magnetic field emissions comprising:

at least one electrically conductive heating element having a body comprising first and second portions that are twisted about each other such that magnetic flux emitted from current flowing in one portion is substantially cancelled by magnetic flux emitted from current flowing in the other portion;

a backing material for attaching said heating element thereto; and a bonding material at least partially overlying said first and second portions of said heating element, wherein said bonding material fixedly connects said portions of said heating element that are twisted about each other and also bonds said heating element to said backing material such that the portions are restricted from movement relative to each other thereby minimizing variations in flux cancellation between the portions if the heating element is flexed.

11. A heater according to claim 10 further comprising an adhesive layer attached to said backing material for adhering said backing material and heating element to a surface.

12. A heater having reduced stray magnetic field emissions comprising:

a backing material; and at least one electrically conductive heating element attached to said backing material, wherein said heating element has a body comprising first and second portions that are twisted about each other such that magnetic flux emitted from current flowing in one portion is substantially cancelled by magnetic flux emitted from current flowing in the other portion, and wherein said heating element forms a zigzag pattern on said backing material, wherein for each zigzag portion, said body of said heating element forms a triangle having sides r and a base 2×, wherein said first and second portions of said heating element have a length L and said backing material has an area with a length d and a width w defined thereon, and wherein half the length of said base of said triangle formed by a zigzag portion of said heating element is:

$$x=w[(L^2/d^2)-1]^{-1/2}.$$

13. A heater having reduced stray magnetic field emissions comprising:

a substrate having first and second opposed sides;

first and second heating element traces respectively located on the first and second opposed sides of said substrate, said first and second traces overlying each other on opposed sides of said substrate;

a first connection pad located on said first side of said substrate and in electrical communication with an end of said first trace;

a second connection pad also located on said first side of said substrate and in electrical communication with an end of said second trace, wherein said second connection pad is located on the first surface of said substrate at a location offset from the location of said first connection pad by a selected offset distance, and wherein a portion of said second trace is offset from the position of said first trace in order to connect to said second connection pad; and first and second leads electrically connected respectively to said first and second connection pads, wherein said first lead extends along said first surface of said substrate overlying the portion of said second trace that is offset from said first trace.

14. A heater having reduced stray magnetic field emissions comprising:

a substrate having first and second opposed sides;

first and second heating element traces respectively located on the first and second opposed sides of said substrate, said first and second traces having at least one of a corresponding pattern and a corresponding position relative to each other such that magnetic flux emitted from current flowing in said first trace is substantially cancelled by magnetic flux emitted from current flowing in said second trace;

a first connection pad located on said first side of said substrate and in electrical communication with an end of said first trace;

a second connection pad also located on said first side of said substrate and in electrical communication with an end of said second trace, wherein said second connection pad is located on the first surface of said substrate at a location offset from the location of said first connection pad by a selected offset distance, and wherein a portion of said second trace is offset from the position of said first trace in order to connect to said second connection pad; and first and second leads electrically connected respectively to said first and second connection pads, wherein said first lead extends along said first surface of said substrate overlying the portion of said second trace that is offset from said first trace, such that magnetic flux emitted from current flowing in the offset portion of said second trace is substantially cancelled by magnetic flux emitted from current flowing in said first lead.

15. A heater according to claim 14 further comprising a via extending between the first and second surfaces of said substrate for connecting together the ends of said first and second traces opposite said ends connected respectively to said first and second connection pads so as to create a continuous electrical circuit from said first connection pad to said second connection pad.

16. A heater according to claim 14, wherein said first and second leads are twisted about each other such that magnetic flux emitted from current flowing in one lead is substantially cancelled by magnetic flux emitted from current flowing in the other lead.

17. A heater having reduced stray magnetic field emissions comprising:

a substrate having first and second opposed sides;

a first heating element trace having first and second ends located on the first side of said substrate;

a second heating element trace having first and second ends located on the second side of said substrate, wherein said second trace overlies said second trace, such that magnetic flux emitted from current flowing in said first trace is substantially cancelled by magnetic flux emitted from current flowing in said second trace;

a first connection pad located on said first side of said substrate and in electrical communication with an end of said first trace;

a second connection pad also located on said first side of said substrate and in electrical communication with an end of said second trace, wherein said second connection pad is located on the first surface of said substrate at a location that is an extension by an offset distance passed the location where said first connection pad and said first end of said first trace are connected, and wherein a portion of said second trace extends past the first end of said first trace by the offset distance to connect to said second connection pad; and first and second leads electrically connected respectively to said first and second connection pads, wherein said first lead extends along said first surface of said substrate overlying the portion of said second trace that is offset from said first trace, such that magnetic flux emitted from current flowing in the offset portion of said second trace is substantially cancelled by magnetic flux emitted from current flowing in said first lead.

* * * * *